United States Patent [19]

Beck

[11] 3,937,189

[45] Feb. 10, 1976

[54] FAN SHROUD EXIT STRUCTURE

[75] Inventor: Harold D. Beck, Downers Grove, Ill.

[73] Assignee: International Harvester Company, Chicago, Ill.

[22] Filed: Jan. 28, 1974

[21] Appl. No.: 437,127

[52] U.S. Cl. ..... 123/41.49; 165/51; 165/122; 165/134; 180/54 A; 415/210; 415/219 R; 415/DIG. 1

[51] Int. Cl.[2] ..... F01P 11/10

[58] Field of Search ..... 165/134, 51, 122; 123/41.48, 41.49; 180/54 A, 68 R; 415/210, 219 R, DIG. 1

[56] References Cited

UNITED STATES PATENTS

| | | | |
|---|---|---|---|
| 2,703,075 | 3/1955 | Sanders | 123/41.49 |
| 2,896,595 | 7/1959 | Guillo-Quevedo | 123/41.49 |
| 3,144,859 | 8/1964 | Walton | 123/41.49 |
| 3,635,285 | 1/1972 | Davis | 165/51 |
| 3,727,593 | 4/1973 | Enke | 123/41.49 X |

*Primary Examiner*—Albert W. Davis, Jr.
*Assistant Examiner*—Sheldon Richter
*Attorney, Agent, or Firm*—Frederick J. Krubel; Floyd B. Harman

[57] ABSTRACT

A heat exchanger apparatus for a liquid-cooled internal combustion engine including a radiator axially spaced from the engine, an engine driven, suction type fan axially spaced intermediate the engine and radiator for drawing cooling air axially through the radiator, and fan shroud means shaped and positioned with respect to the radiator and the blades of the fan whereby the major component of the air stream discharged by the fan is in a direction reversed to the direction to the major component of the air stream entering the radiator. The fan shroud structure is formed to provide a generally cylindrical exit throat section (CF), a radial flat discharge section (RF), and a radial expander or diverging section (R) serving as a transition between the throat section and the radial exit section and wherein the propeller-type blades of the fan have a projected axial width (AW). The various shroud structure sections are dimensioned with respect to such projected axial width (AW) of the fan blades and the fan blades are positioned with respect to such shroud structure sections in the following manner: CF = AW/3, RF = AW/3, R = 2AW/3, and the radial plane containing the trailing edges of the fan blades is axially spaced outwardly from the radial plane containing the radial exit section (RF) a distance $X_E$ and wherein the magnitude of $X_E$ is between 60 and 75 percent of the projected axial width (AW) of the fan blades.

5 Claims, 5 Drawing Figures

FAN SHROUD EXIT STRUCTURE

This invention generally relates to a cooling assembly for a liquid-cooled internal combustion engine and more particularly to a cont fan shroud exit structure for directing the air stream in a particular manner therefrom.

Most vehicles in general use today are propelled by internal combustion engines and such engines, as is well known, generate heat during the operation of the same. For the most part, the motor vehicle internal combustion engines employed commercially are of the liquid-cooled type which entails the circulation, under pressure, of a coolant through the engine for absorbing heat. The correct operating temperature of the engine is maintained by subsequently passing, under pressure, the heated coolant received from the engine through a heat exchanger system for dissipating heat from the coolant to the atmosphere and returning the coolant to the engine for recirculation in the engine. Generally, the heat exchange system employed includes a heat exchanger or radiator through which the heated coolant received from the engine is caused to flow. Simultaneously, air is also caused to flow through the radiator which absorbs the heat from the heated coolant and carries it out into the atmosphere.

The cooling capacity of a heat exchanger system of the type to which the present invention relates is dependent upon many factors including the velocity and volume of the air caused to flow through the radiator. One type of air moving system employed for obtaining the necessary air flow through the radiator in order to maintain the desired operating temperature of the engine involves a fan of the axial flow, suction type. That is, the fan assembly is designed to suck or draw air from the atmosphere and cause the air stream to flow substantially axially through the radiator. Heretofore, in most vehicle installations, the air stream after passing through the radiator was discharged back over the entire engine which is usually spaced axially rearwardly of the fan and radiator. Thereafter, the heat-ladened air had to somehow exit exteriorly of the engine compartment to the atmosphere. Inasmuch as the conventional axial flow suction type fan discharges the heat-ladened air directly into the engine compartment and since, in many vehicles, the operator's station is located directly rearwardly of the engine compartment there is a possibility that such heat-ladened air stream will enter the operator's environment and result in an adverse effect on the operator. Moreover, when the vehicle is performing tasks that generate large amounts of dust or air borne particles such material will oftentimes settle in the engine compartment and in the operator's compartment. The aforementioned dust problem is found in many cases to have a detrimental effect upon the engine and its performance as well as upon the efficiency and comfort of the operator. It is, therefore, an object of this invention to provide a heat exchanger system for a motor vehicle engine wherein an axial flow suction type fan is employed, which draws air from the exterior of the vehicle forwardly of the radiator and expels the air from the engine compartment in the form of an air stream having a major velocity component opposite to the direction of the air stream passing through the radiator in order to mitigate the above-mentioned and other inherent shortcomings of conventional motor vehicle heat exchanger system utilizing a suction type fan axially spaced intermediate a forwardly mounted radiator and an engine disposed rearwardly therefrom.

Another object is to provide a fan shroud exit structure — cooling air fan relationship whereby the exhaust air stream is capable of being directed in an axial direction 180° reversed from the axial direction of the air stream passing through the radiator.

Still another object is to provide a heat exchanger system for a motor vehicle including a new and improved fan shroud exit structure and a novel positioning of such fan shroud exit structure with respect to the cooling fan blades whereby the direction of the discharge air stream is readily and accurately controllable.

In accordance with the preferred embodiment of the present invention, a motor vehicle of the type having a liquid-cooled internal combustion engine is provided with an engine cooling heat exchanger system, which, in turn, includes a conventional, generally upright radiator, mounted axially forwardly of the engine, through which the engine cooling is circulated in the usual manner. The heat exchanger system also includes a conventional multi-bladed, axial flow, suction-type fan, axially spaced intermediate the radiator and engine, for drawing air rearwardly and axially through the radiator core. A fan shroud means is operatively connected to the rear face of the radiator and includes a uniquely contoured exit structure. As will be pointed out hereinafter in detail, the fan is positioned with respect to the fan shroud exit structure in such a manner that the air stream after passing through the radiator core, may be "bent" and caused to flow in an axial direction reversed to the direction of the air flow passing through the radiator core.

The foregoing and other important objects and desirable features inherent in and encompassed by the invention, together with many of the purposes and uses thereof, will become readily apparent from a reading of the ensuing description in conjunction with the annexed drawings, in which.

Figure 3:
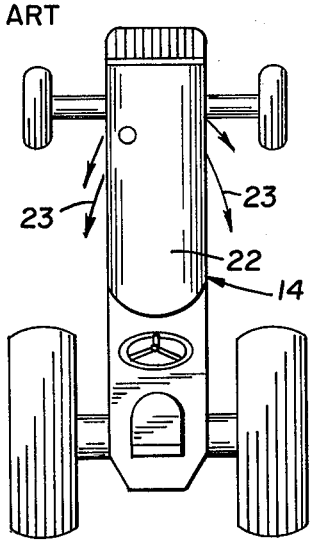
FIG. 3 PRIOR ART
Figure 4:
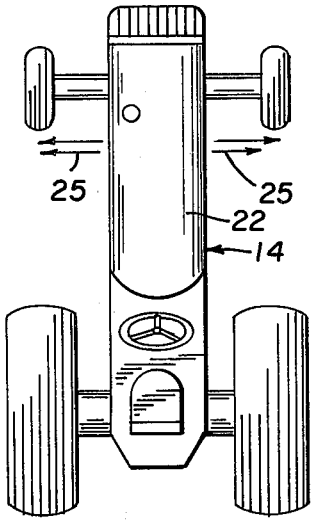
Figure 5:
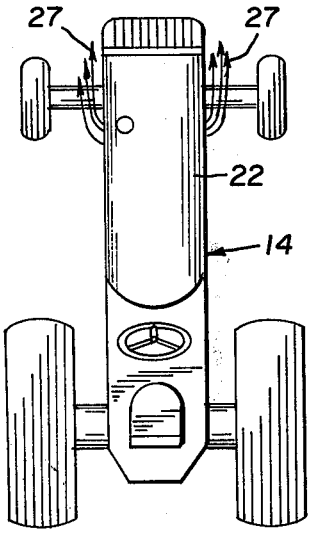

FIG. 3 is a top view of a tractor showing the direction of the exiting air stream when equipped with a conventional prior art heat exchanger system; and FIG. 4 is a top view of a tractor showing the direction of the exiting air stream achieved when the tractor is equipped with a heat exchanger apparatus of the present invention and the fan blades are located in a first position with respect to the fan shroud exit section; and FIG. 5 is a top view of a tractor, similar to FIG. 4, showing the direction of the exiting air stream achieved when the tractor is equipped with a heat exchanger apparatus of the present invention and the fan blades are located in a second position with respect to the fan shroud exit section.

While the invention will be described in connection with a preferred embodiment, it will be understood that it is not intended to limit the invention to that embodiment. On the contrary, it is intended to cover all alternatives, modifications, and equivalents as may be included within the spirit and scope of this invention as defined by the appended claims.

Figure 1:
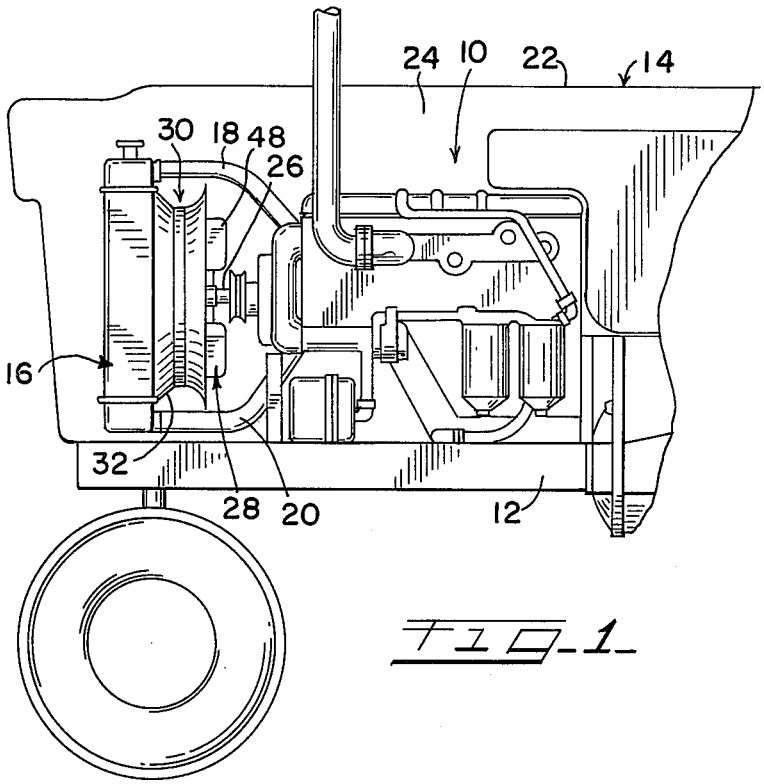
FIG. 1 is a side elevation of an internal combustion engine showing the device of the invention in conjunction with a vehicle.

Turning first to FIG. 1 there is shown a conventional liquid-cooled heat producing internal combustion engine means 10 carried forwardly on a longitudinally extending parallel frame support means 12 of a vehicle 14. As shown herein the vehicle 14 is a tractor. However, as will hereafter become more apparent this invention can be applied to any type of vehicle employing a heat-generating engine, whether internal or external combustion, or any other portable or stationary heat exchange system, whether used in conjunction with an engine or not requiring an air moving fan, fan shroud means, and a heat exchanger. Forwardly mounted is a water cooling radiator 16 employed to dissipate the engine generated heat. Water or coolant flows between the water jacket on the engine (not shown) and the radiator core through a series of fluid communicating means 18 and 20. In this particular embodiment a sheet metal structure 22 substantially encloses engine 10 thereby forming or defining the engine compartment space 24.

Carried at the forward end of engine 10 is an engine-driven fan shaft 26 to which an axial flow, section-type fan 28 is operatively connected whereby power is delivered to drive the fan 28. As is apparent the particular means whereby power is transmitted to the fan 28 from the engine 10 is not critical and belts and pulleys or other form of known transmission could also be employed. As employed here, fan 28 is a rotatable suction fan positioned adjacent one side of the radiator 16 at the forward end of the engine, and, as normally employed in the prior art, creates a flow of air by drawing in a stream of cooling air axially and rearwardly through the core of the radiator 16 with subsequent discharge thereof in generally the same direction. This axial flow of air is directed by a shroud means 30. The particular shape of the forwardmost section 32 of the shroud means 30 is dependent upon the shape or configuration and design of the radiator. The nature of the connection between the forwardmost edge of the shroud section 32 and the rear or air exiting face 34 of the radiator 16 will be dependent upon the particular characteristics of these components. That is, some connections being provided with air gaps while others are substantially sealed over the entire periphery of the mating structures. In the preferred form of this invention the entire rear face 34 of the radiator 16 is substantially sealed against the passage of air at the joint between the radiator 16 and the shroud section 32. From the forward edge or edges of the shroud means 30 (be it a taper transition as shown or a box type) the shroud section 32 is formed so that it converges rearwardly and axially whereby its rearwardmost edge 36 is substantially a circle.

Figure 2:
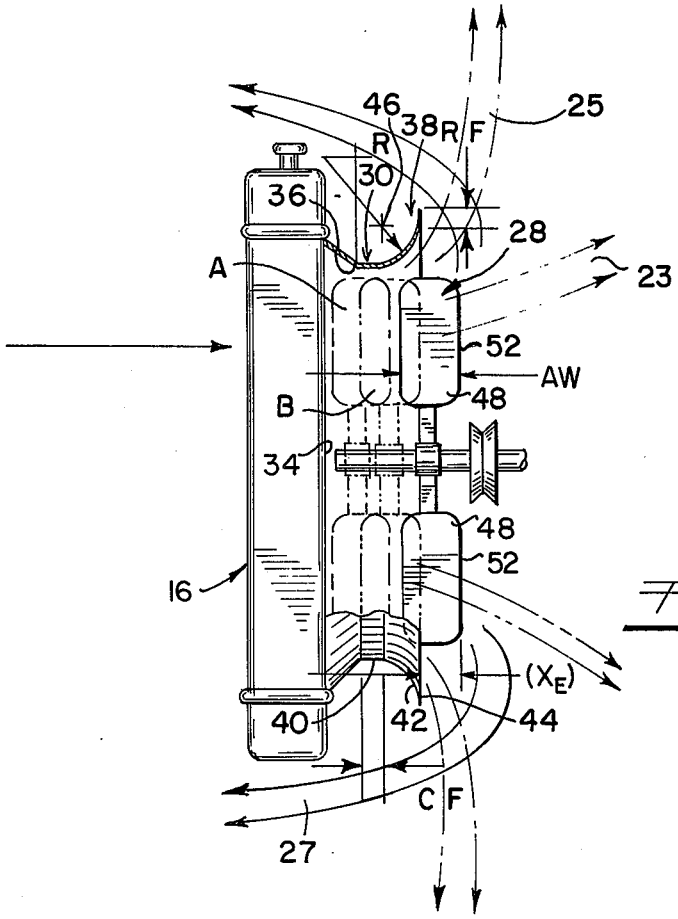
FIG. 2 is a fragmentary vertical section showing the spatial relationship of the fan to the contoured exit section.

Referring now to FIG. 2 wherein is more clearly shown an exit shroud means 38 extending axially rearwardly and radially outwardly from shroud edge 36. The connection or joint between the shroud section 32 and the exit shroud means 38 can be achieved by any suitable means. However, it is desirable that such connection or joint be relatively free of gaps or spaces which allow the passage of air. Exit shroud means 38 includes a generally cylindrical section 40, an arcuate or curved portion or section 42, and a radially extending flat flange portion or section 44. For the most part cylindrical shroud section 40 defines the leading or entrance end of the exit shroud means 38. The arcuate or curved portion 42 extends radially outwardly and axially rearwardly from the opposite or rearwardmost edge of the cylindrical shroud section 40. The arcuate or curved portion 42 has a radius of curvature R which extends from an infinite number of reference points 46, all of which lie in a plane containing the rearwardmost edge of the cylindrical shroud section 40. The reference points 46 also lie in a circle having a diameter equal to the diameter of the cylindrical shroud section 40 plus two times the radius of curvature R. That is, arcuate section 42 has a generally bell-shaped appearance, being a section of a transition surface or some approximation thereof. In the preferred embodiment arcuate section 42 has a constant radius of curvature R. Flat flange portion 44 forms the trailing edge of exit shroud means 38 and lies in a radial plane perpendicular to that of cylindrical section 40. Overall, the entire fan exit shroud means 38 has a horn-like configuration.

As previously stated, fan 28 is rotatably carried adjacent one side of said radiator 16 and is operable to establish a flow of cooling air therethrough. Fan 28 includes a plurality of radially extending fan blades 48 (only one of which is shown) as is well known in the art. As shown in FIG. 2, fan 28 is partially surrounded or encircled by said exit shroud means 38. The enclosure or encirclement of the fan 28 within shroud means 30 is such that a rear radial plane struck out by trailing edges 52 of the fan blades 48 is axially spaced beyond or rearwardly of and is parallel to the plane containing the radial flat flange portion 44, and preferably, to achieve the objects of the invention, such axial spacing ($X_E$) is between 60 to 75 percent of the projected axial width (AW) of the fan blades 48. The projected axial width (AW) of the fan blades 48 is defined as the spacing, measured in an axial direction, between the radial planes respectively containing the leading and trailing edges of the fan blades 48. It should be noted, however, that there is a plus or minus error factor involved in both the upper and lower limits of about 5 percent of (AW). That is, ($X_E$) can be as low as 55 percent of (AW) or as great at 80 percent of (AW) and still function reasonably satisfactory within the scope of this invention. Thus, within this range where ($X_E$) is between 55 to 80 percent of (AW), the deflected air stream will still be generally reversed axial 180°, as shown in FIG. 5 and by arrows 27. The two phantom positions shown in FIG. 2, A and B are included for purposes of demonstration. When fan 28 is positioned substantially into the fan shroud assembly as in A the resultant air pattern is generally axially rearwardly. That is, as shown in FIG. 3 and by arrows 23. Movement outwardly to position B, as more fully discussed, and explained in my co-pending application Ser. No. 348,436, filed Apr. 5, 1973 and assigned to the assignee of the present invention, wherein the trailing edges 52 of the fan blades 48 and the radial flat shroud section 44 lie in a common radial plane the air discharge pattern beomes radial as shown in FIG. 4 and by arrows 25.

The following relationship exists between these parameters: RF = AW/3, CF = AW/3, and R = 2AW/3 where RF is the radial length of the radial flat portion 44, CF is the axial length of the cylindrical throat section 40, and R is the radius of the arcuate or curved section 42 or distance from the reference point to the transition surface (the radius of curvature) and AW is the projected axial width of the fan blades 48 of the fan 28, as defined above.

The spatial relationship of the fan 28 to the exit shroud means 38 is most conveniently expressed in terms of the percentage ($X_E$) of the projected fan blade axial width (AW) which is exposed past a plane which passes through the radial flat portion or section 44. It has been found where 60% $\leqq X_E \leqq$ 75% optimum reversed axial air flow is achieved. However, reasonable results can still be achieved even though the range of ($X_E$) is expanded by 5 percent of (AW) at its upper and lower limits of 75 and 60 percent of (AW), respectively.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A heat exchange apparatus comprising:

a heat exchange means having front and rear faces;

shroud means operatively connected to said heat exchange means about its rear face, said shroud means including a rearwardly extending exit shroud means comprising a radially outwardly and axially rearwardly extending curved shroud section and a flat portion extending radially outwardly from one end of said curved section;

an axial flow, suction-type fan having a plurality of fan blades, each of said fan blades having a trailing edge and a leading edge, said leading edges lying generally in a first radial plane and said trailing edges lying generally in a second radial plane axially spaced rearwardly from said first radial plane a distance AW and wherein the following relationship within plus or minus 12 percent of AW exists: RF = AW/3 where RF is the radial length of said radially extending shroud flat portion and R = 2AW/3 where R is the radius of curvature of said curved shroud section; and said second radial plane being axially spaced rearwardly from the radial plane containing said radially extending shroud flat portion a predetermined distance ($X_E$) having a value of more than 50 but less than 100 percent of said axial distance AW.

2. A heat exchange apparatus as set forth in claim 2, wherein said predetermined distance ($X_E$) has a value of 55 to 80 percent of said axial distance AW;

3. A heat exchange apparatus comprising; a heat exchange means having front and rear faces;

shroud means including an entrance shroud means having forwardmost edge means arranged to encircle said rear face of said heat exchange means, and a rearwardly extending exit shroud means having forwardmost edge means joined to rearwardmost edge means of said entrance shroud means, said exit shroud means including in successive sections a generally cylindrical throat section, a radial curved section and a radial flat portion;

an axial flow, suction-type fan having a plurality of fan blades, each of said fan blades having a trailing edge and a leading edge, said leading edges lying generally in first radial plane and said trailing edges lying generally in a second plane axially spaced rearwardly from said first radial plane a distance AW, and said second radial plane being axially spaced rearwardly from the radial plane containing said radial flat portion a distance ($X_E$) wherein the following relationship within plus or minus 12 percent AW exists: RF = AW/3, CF = AW/3, and R = 2AW/3 where RF is the radial length of the radial flat portion, CF is the axial length of the cylindrical throat section, R is the radius of the radial curved section and ($X_E$) has a value of 60 to 75 percent of the axial distance AW.

4. In a cooling system for an internal combustion engine, the combination, comprising:

a liquid-cooled internal combustion engine;

a generally upright radiator axially spaced forwardly of said engine having front and rear faces;

means for circulating a liquid coolant between said radiator and said engine;

shroud means extending generally rearwardly and axially from said radiator including an entrance shroud means having forwardmost edge means operatively connected to said radiator about its rear face and an exit shroud means extending rearwardly from said entrance shroud means, said exit shroud means comprising a generally cylindrical throat section having a forwardmost edge means joined to a rearwardmost edge means of said entrance shroud means, a radially outwardly and axially rearwardly extending curved shroud section operatively connected to the rearwardmost end of said throat section and a flat portion extending radially outwardly from the rearwardmost end of said curved shroud section;

an axial flow, suction-type fan axially spaced intermediate and said radiator and engine, and driven by said engine, said fan having a plurality of fan blades, each of said fan blades having a trailing edge and a leading edge, said leading edges lying substantially at a first radial plane and said trailing edges lying generally in a second radial plane axially spaced rearwardly from said first radial plane a distance AW, and said second radial plane being axially spaced rearwardly from the radial plane containing said radially extending shroud flat portion of predetermined distance ($X_E$), said predetermined distance ($X_E$) having a value of at least 55 percent of said axial distance AW, and wherein the following relationships within plus or minus 12 percent of AW exists: R = 2AW/3, CF = AW/3, and RF = AW/3 where R is the radius of curvature of the curved shroud section; CF is the axial length of the shroud throat section, and RF is the radial length of the radially extending shroud flat portion.

5. In a cooling system for an internal combustion engine as set forth in claim 4, wherein the value of said predetermined distance ($X_E$) is equal to or less than 80 percent of said axial distance AW.

* * * * *